United States Patent [19]

Ottesen

[11] 4,209,763

[45] Jun. 24, 1980

[54] INDUCTION VOLTAGE TRANSFORMER

[75] Inventor: Otto Ottesen, Ludvika, Sweden

[73] Assignee: ASEA Aktiebolag, Vesteras, Sweden

[21] Appl. No.: 905,458

[22] Filed: May 12, 1978

[30] Foreign Application Priority Data

May 16, 1977 [SE] Sweden ..... 7705668

[51] Int. Cl.[2] ..... H01F 15/14; H01F 27/28

[52] U.S. Cl. ..... 336/70; 336/225

[58] Field of Search ..... 336/69, 105, 107, 70, 336/231, 84 R, 84 C, 225, 170; 361/268, 270

[56] References Cited

U.S. PATENT DOCUMENTS

| | | | |
|---|---|---|---|
| 1,034,929 | 8/1912 | Reynders et al. | 336/70 |
| 1,940,864 | 12/1933 | Hodnette | 336/70 |
| 3,265,998 | 8/1966 | Park | 336/70 |
| 3,845,436 | 10/1974 | Robin | 336/84 C |

FOREIGN PATENT DOCUMENTS

| | | | |
|---|---|---|---|
| 517838 | 2/1940 | United Kingdom | 336/70 |

*Primary Examiner*—Thomas J. Kozma

*Attorney, Agent, or Firm*—Watson, Cole, Grindle & Watson

[57] ABSTRACT

An induction voltage transformer which includes an iron core positioned in a grounded metal tank, the iron core having one leg wrapped by an insulating body constructed as a capacitively controlled bushing, and a high voltage body arranged outside of a portion of the insulating body, the high voltage body including successively displaced layers of a high voltage wire winding. A low voltage wire winding is then wrapped around the outermost layer of the high voltage wire winding.

5 Claims, 1 Drawing Figure

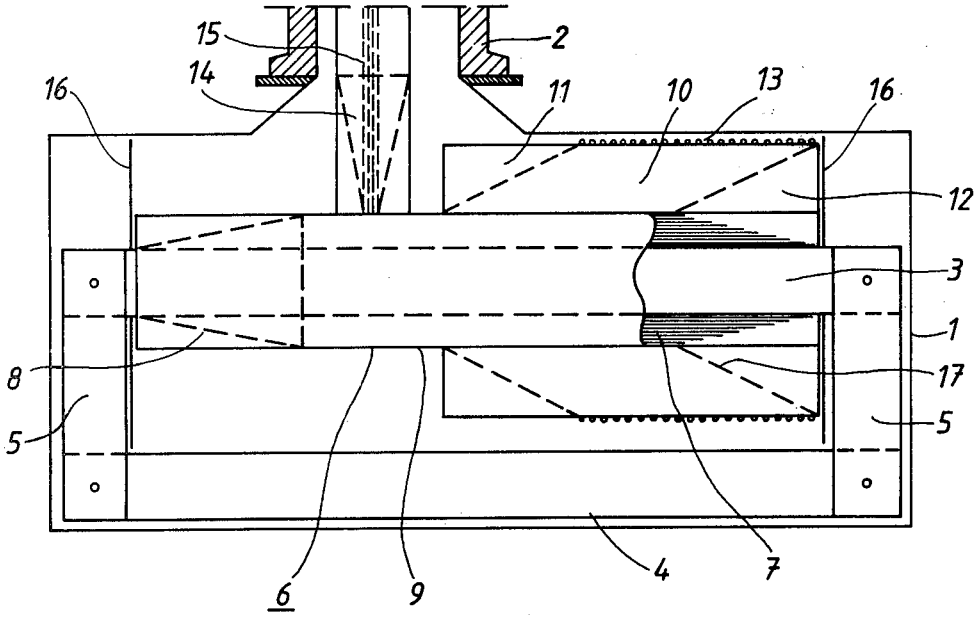
15
2
14
16
11
10
13
16
12
3
1
8
17
5
5
6
9
4
7

INDUCTION VOLTAGE TRANSFORMER

BACKGROUND OF THE INVENTION

FIELD OF THE INVENTION

The present invention relates to an inductive voltage transformer of the type which has an iron core positioned in a grounded, insulating oil-containing metal tank.

DESCRIPTION OF THE PRIOR ART

Conventional inductive voltage transformers usually comprise a grounded metal tank in which is positioned an iron core having both low and high voltage windings wrapped therearound, the low voltage windings being wrapped around the iron core first, and the high voltage windings then being wrapped around the low voltage windings. Due to the need for a sufficient insulation barrier between the high voltage windings and the metal tank, a barrier of insulating paper is wound around the high voltage windings, i.e., to give aide to the insulating characteristics of the insulating oil present in the tank. However, the end portions of the so used insulating paper must be formed against the winding by hand, and the quality of the insulation barrier is thus to a great extent dependent upon the person performing the work. In addition, the paper barrier layer between the high voltage windings and the grounded tank must be made quite thick when high voltages are used, and the fabrication of the barrier layer, and thus the production of core (and the entire transformer), can be very time consuming.

Proposals have already been made to locate an insulating body, designed as a capacitively controlled bushing, between the outer high voltage windings and the inner low voltage windings, as in Canadian Pat. No. 1,026,439. Such a technique acts to affect the field around the high voltage winding in a simple fashion. The high voltage winding as a unit is therefore constructed using a number of series-connected coils, arranged axially, one after the other, along a leg of the core. The construction according to Canadian Pat. No. 1,026,439 eliminates the need for manual wrapping of insulating paper around the high voltage winding; however, a relatively large insulating distance must be maintained between the high voltage winding and the grounded metal tank, thus requiring the use of a large metal casing.

It is an object of the present invention to produce an inductive voltage transformer which is simple to construct, inexpensive to manufacture, and which can be contained in a metal casing of reduced dimensions.

SUMMARY OF THE INVENTION

According to the present invention the low voltage windings as a unit are arranged to be on the outside of the high voltage windings as a unit in relation to the iron core. The resulting transformer displays a favorable field control, can be made smaller in size than that according to the previously noted Canadian Patent, and an outer barrier of insulating material is not required around the high voltage winding.

DESCRIPTION OF THE FIGURE

The accompanying FIGURE depicts in schematic form the lower part of an inductive voltage transformer according to the present invention, the upper part being conventional (see the above-noted Canadian Patent).

DESCRIPTION OF THE PREFERRED EMBODIMENT

The base of the voltage transformer is shown as metal bottom tank 1 which is itself connected to the ground via grounding wires (not shown). The tank 1 supports a tubular porcelain insulator 2 which in turn supports a top cover with connection means for an external conductor (not shown).

Within the tank 1 is positioned the iron core of the transformer, this iron core including legs 3 and 4 with connecting yokes 5. Core leg 3 is surrounded with a hollow, cylindrical insulating body 6 which is itself built up on a known manner by winding insulating paper having the same width as the length of the insulating body around the core leg 3, and at the same time inserting metal foils 7 between the paper turns. The metal foils 7 have diminishing lengthwise dimensions as shown in the right-hand portion of the FIGURE to form a conical control portion 8 at either end of the insulating body 6, the cylindrical central portion being labelled as 9.

A high voltage body is positioned around the insulating body 6, the high voltage body including a high voltage wire wound around insulating body 6 in layers to form wire winding 10, with the inner end of the high voltage wire winding (in the innermost layer) being electrically connected to the outermost metal foil layer 7 of the insulating body 6, and the other end of the wire winding (in the outermost layer) being connected to the tank 1 (and thus to ground). Preferably, the consecutive layers of wire windings which form the winding 10 are formed so as to be successively displaced in an axial direction with respect to one another to form a wire winding having a rhomboid-type cross-section 17. The end portions 11, 12 of the high voltage body are formed by the layers of paper insulation which are of course positioned between the successive wire winding layers. The high voltage body is thus in the form of a compact cylinder. A low voltage wire winding 13 is then arranged outside of the outermost layer of the high voltage wire winding 10.

A slotted metal ring 16 is located around the core leg 3 at each end thereof just past the ends of the insulating body 6 to screen the field against the iron core.

Inside of the insulator 2 is a capacitively controlled bushing 14 which includes therein a connecting conductor 15 which at its upper end is connected to a top cover and at its lower end is connected to the outermost conducting foil layer 7 of insulating body 6, and thus is electrically connected to the innermost end of the high voltage wire winding.

When in use, the tank 1 is filled with insulating oil to a certain level in the top cover (not shown), which top cover acts as an expansion vessel.

It should be obvious that in the embodiment shown the insulating body 6 and the windings 10 and 13 can be produced quite easily in a simple winding machine, i.e., with a minimum of manual labor required. Since the innermost wire layer of the high voltage wire winding 10 extends axially only to the same point as the conical control section 8 of insulating body 6 (see right-hand portion of the FIGURE), whereas the additional layers are successively displaced axially, a favorable field control is achieved, with the paper portion 12 of the high voltage body surrounding the end portion of the insulating body 6. Due to the conical shape of the high voltage body, it is possible to reduce the control distance between the high potential foils 7 of insulating body 6 and the tank 1. Further, since the low voltage wiring is located outside of the high voltage wiring, no voltage difference prevails between the periphery of the winding body and the tank. Thus, both the dimensions of the tank and the dimensions of the top cover (expansion vessel) can be reduced, and the amount of necessary insulating oil minimized.

Although a preferred embodiment of the invention has been discussed, it should be remembered that additional modifications in the invention will be obvious to those skilled in the art without departing from the invention as defined in the appended claims.

I claim:

1. In an induction voltage transformer which includes a grounded metal tank and an iron core positioned in said metal tank, the iron core having two legs connected at their respective ends by yokes, the improvement wherein one leg of said iron core has an insulating body closely positioned therearound, said insulating body including layers of metal foil having successively shorter dimensions along the axial length of said core leg for each successively outermore layer so as to act as a capacitively controlled bushing, a high voltage body positioned around a portion of said insulating body, said high voltage body including layers of a high voltage wire winding, said layers of said high voltage wire winding of said high voltage body being successively displaced along the axial direction of said core leg so as to form a high voltage wire winding of rhomboid-type cross-section, the innermost wire winding layer of said high voltage wire winding of rhomboid-type cross-section extending axially only to the same point as the outermost layer of said layers of metal foil in said insulating body, and a low voltage wire winding wrapped around the outside of the outermost layer of said high voltage wire winding of said high voltage body.

2. The induction voltage transformer of claim 1 wherein said grounded metal tank supports a tubular insulator, and wherein a connecting conductor is positioned within said tubular insulator, one end of which is electrically connected to the innermost end of said high voltage wire winding, and the other end to a top cover positioned on said tubular insulator.

3. The induction voltage transformer of claim 2 wherein a capacitively controlled bushing is positioned within said tubular insulator, and wherein said connecting conductor is positioned to extend centrally therethrough.

4. The voltage transformer of claim 2 wherein said one end of said connecting conductor is connected to the outermost layer of said layers of metal foil of said insulating body.

5. The voltage transformer of claim 4 wherein the innermost end of said high voltage wire winding is electrically connected to the outermost layer of said layers of metal foil of said insulating body.

* * * * *